US005078295A

United States Patent [19]

Grant

[11] Patent Number: 5,078,295

[45] Date of Patent: Jan. 7, 1992

[54] CONTAINER LID SECUREMENT APPARATUS

[76] Inventor: Reginald H. Grant, P.O. Box 337, Hoopa, Calif. 95546

[21] Appl. No.: 682,303

[22] Filed: Apr. 9, 1991

[51] Int. Cl.[5] ..... B65D 45/00

[52] U.S. Cl. ..... 220/318; 292/258; 292/288

[58] Field of Search ..... 220/315, 318; 292/258, 292/288

[56] References Cited

U.S. PATENT DOCUMENTS

| | | | |
|---|---|---|---|
| 1,888,622 | 11/1932 | Cupp et al. | 292/288 |
| 2,238,379 | 4/1941 | Tiffany | 220/318 X |
| 2,636,639 | 4/1953 | Frey | 220/318 |
| 3,291,515 | 12/1966 | Lierman | 292/288 |
| 3,363,924 | 1/1968 | Remig | 292/258 |
| 3,674,298 | 7/1972 | VeKony | 292/258 |
| 3,817,563 | 6/1974 | McGlothlin | 220/318 X |

*Primary Examiner*—Stephen Marcus
*Assistant Examiner*—Nova Stucker
*Attorney, Agent, or Firm*—Leon Gilden

[57] ABSTRACT

An apparatus including a lid for securement to an underlying container, wherein the lid includes a plurality of pivotally mounted linkages to permit tensioning and untensioning from associated springs to permit ease of mounting and dismounting the lid apparatus relative to the associated container in a locking relationship.

2 Claims, 4 Drawing Sheets

10
12
18
12a
11
13
11a 26
24
22
20
19
21
23
25

26
24
22
20
18
19
21
23
25

CONTAINER LID SECUREMENT APPARATUS

BACKGROUND OF THE INVENTION

1. Field of the Invention

The field of invention relates to refuse container apparatus, and more particularly pertains to a new and improved container lid securement apparatus wherein the same is arranged for the latching and locking of a lid structure relative to an underlying container apparatus.

2. Description of the Prior Art

Various mechanisms have been provided in the prior art to lock and secure a lid to an associated container. Such apparatus is exemplified in U.S. Pat. No. 4,413,851 to Ritter wherein a strap member is positioned overlying a lid handle to secure the lid to the associated container.

U.S. Pat. No. 3,679,162 to Burley includes an arcuately shaped frame supporting a plurality of parallel cross members, in turn mounting a plurality of arms spring biased to the arcuate frame for securement to a lid.

U.S. Pat. No. 2,545,320 to Tilson, et al. sets forth a support stand for mounting a container thereon, wherein the support stand includes a plurality of pairs of projections receiving a container therewithin, with a chain member directed about the can to secure the projections for positioning the can in place.

As such, it may be appreciated that there continues to be a need for a new and improved container lid securement apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container lid apparatus now present in the prior art, the present invention provides a container lid securement apparatus wherein the same biases a container lid in a latched and delatched orientation relative to an underlying container. As such, the general purpose of the present invention, which will be described subsequently in greater detail, is to provide a new and improved container lid securement apparatus which has all the advantages of the prior art container lid apparatus and none of the disadvantages.

To attain this, the present invention provides an apparatus including a lid for securement to an underlying container, wherein the lid includes a plurality of pivotally mounted linkages to permit tensioning and untensioning from associated springs to permit ease of mounting and dismounting the lid apparatus relative to the associated container in a locking relationship.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container lid securement apparatus which has all the advantages of the prior art container lid apparatus and none of the disadvantages.

It is another object of the present invention to provide a new and improved container lid securement apparatus which may be easily and efficiently manufactured and marketed.

It is a further object of the present invention to provide a new and improved container lid securement apparatus which is of a durable and reliable construction.

An even further object of the present invention is to provide a new and improved container lid securement apparatus which is susceptible of a low cost of manufacture with regard to both materials and labor, and which accordingly is then susceptible of low prices of sale to the consuming public, thereby making such container lid securement apparatus economically available to the buying public.

Still yet another object of the present invention is to provide a new and improved container lid securement apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an ortogtaphic cross-sectional illustration of the instant invention.

DESCRIPTION OF THE PREFERRED EMBODIMENT

Figure 1:
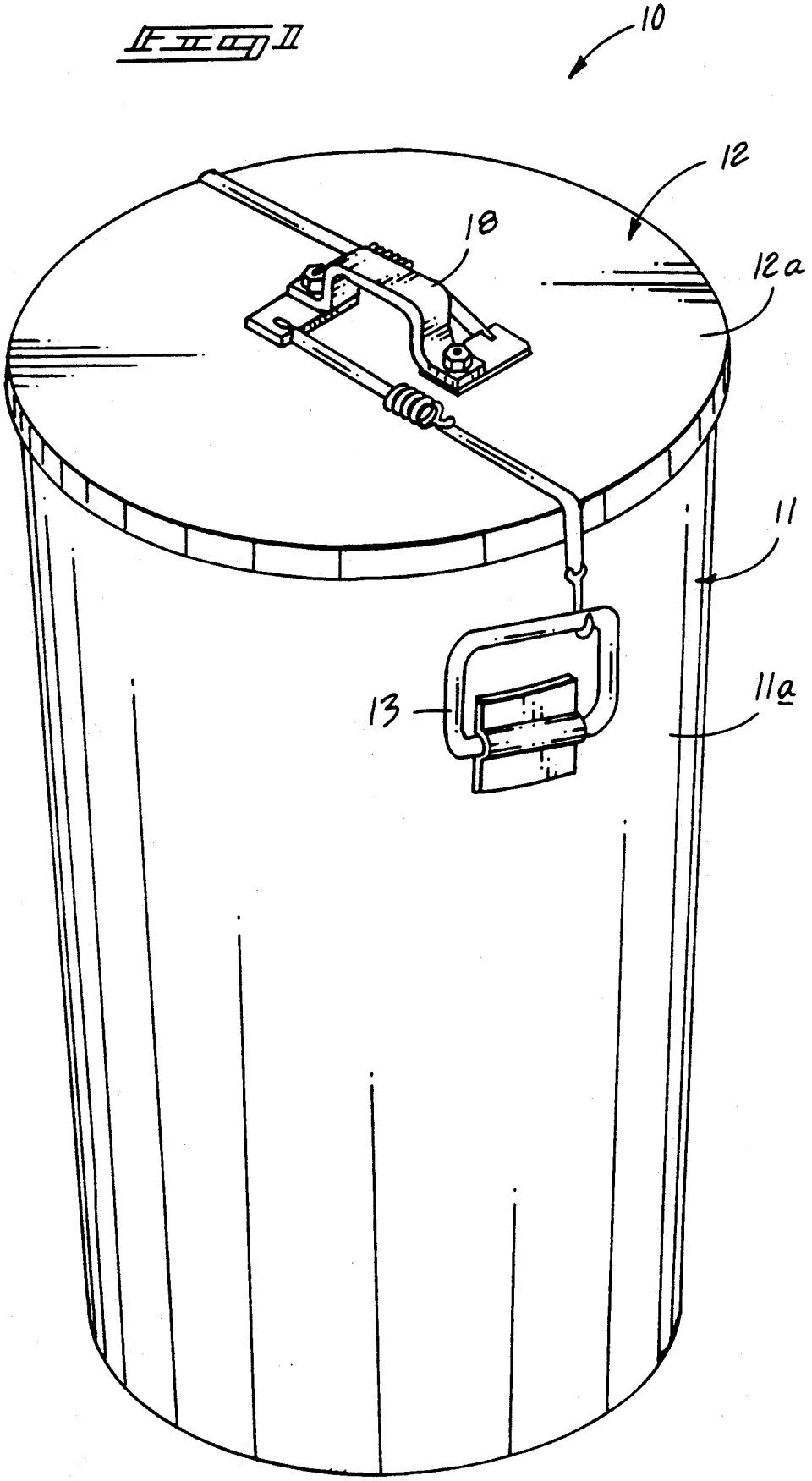
FIG. 1 is an isometric illustration of the instant invention.
Figure 2:
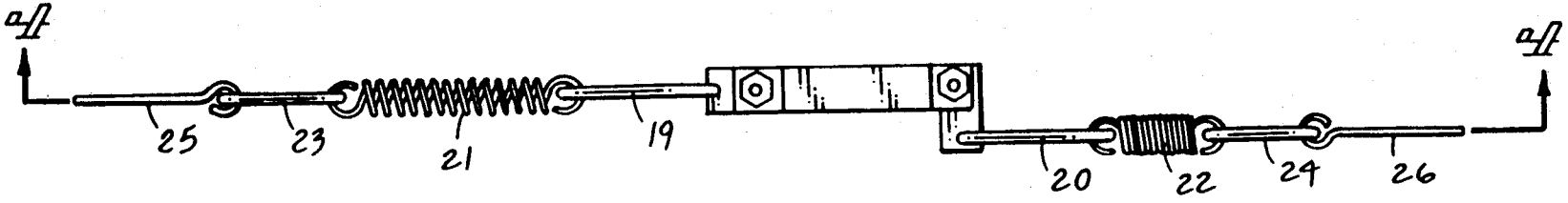
FIG. 2 is an orthographic top view of the instant invention illustrating the latching mechanism of the instant invention.
Figure 3:
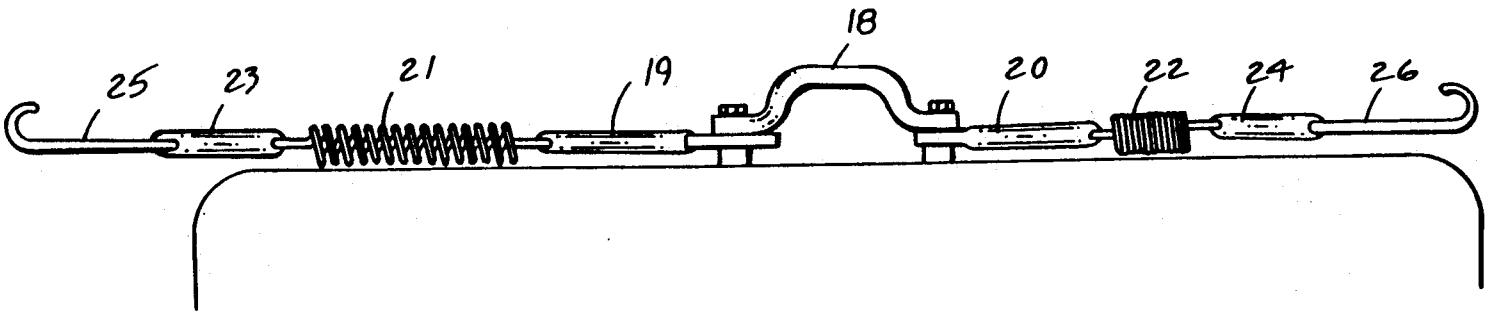
FIG. 3 is an orthographic side view of the instant invention and the latch mechanism relative thereto.
Figure 3:
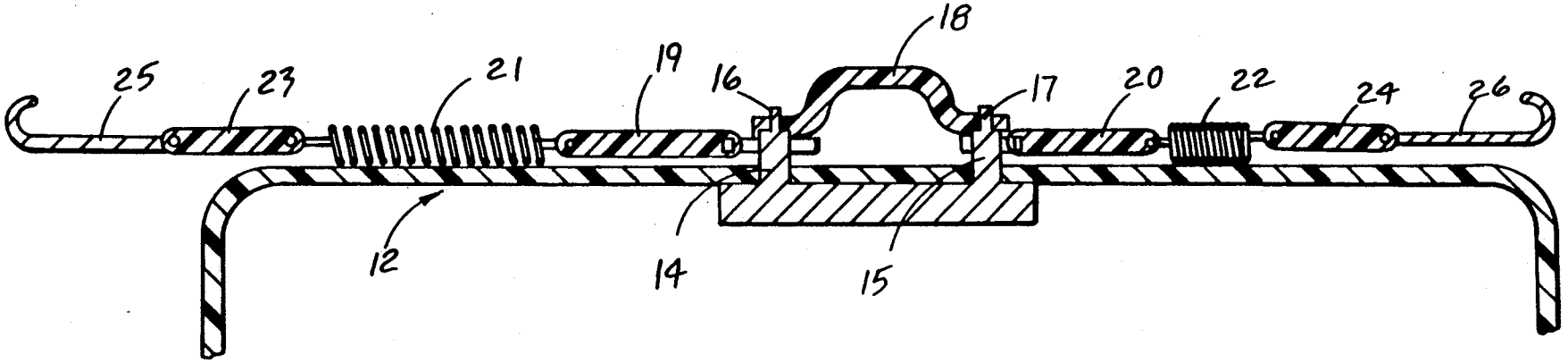
Figure 5:
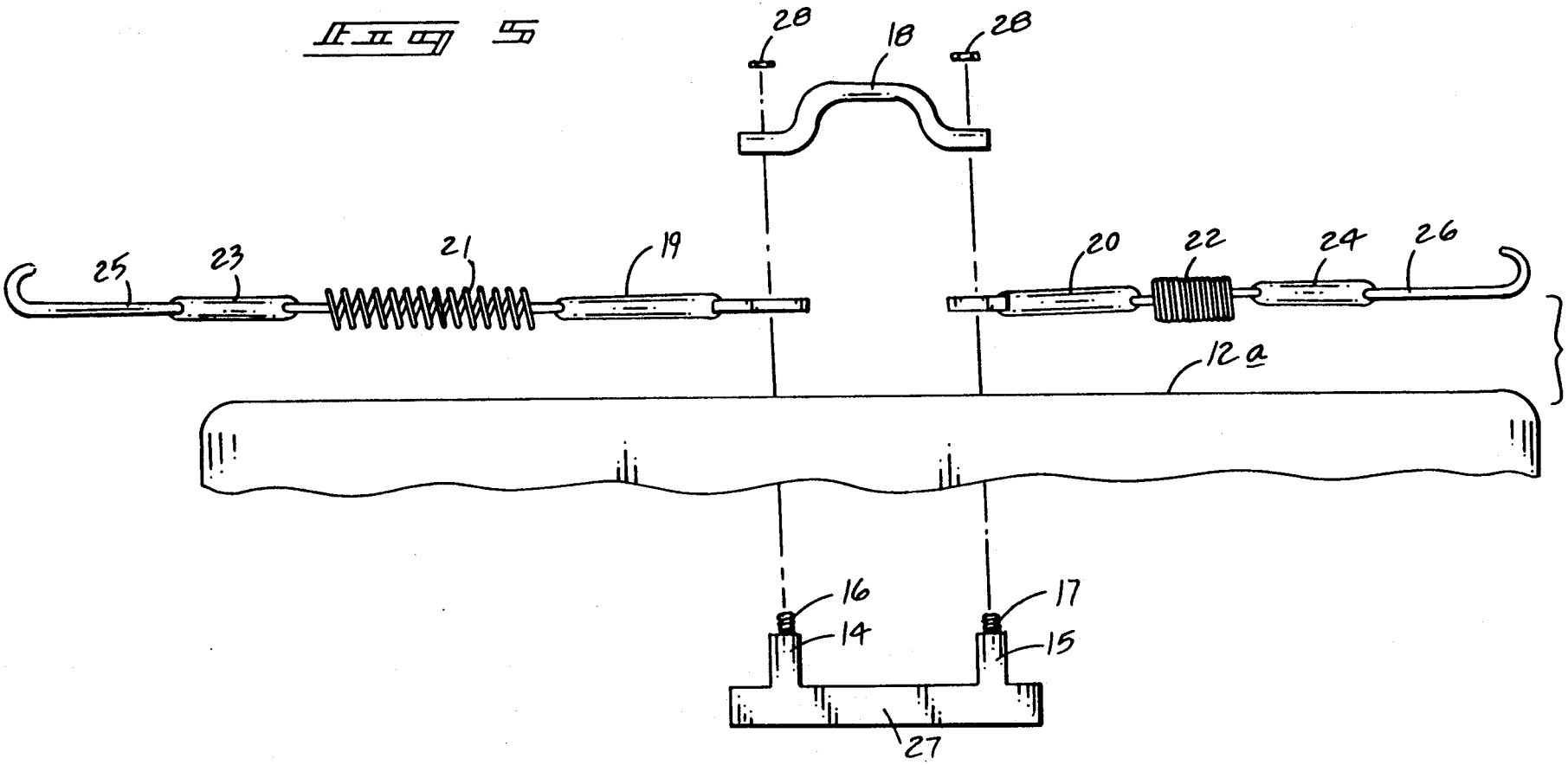
FIG. 5 is an orthographic exploded side view of the instant invention setting forth an inter-relationship relative to the associated container lid.

With reference now to the drawings, and in particular to FIGS. 1 to 5 thereof, a new and improved container lid securement apparatus embodying the principles and concepts of the present invention and generally designated by the reference numeral 10 will be described.

More specifically, the container lid securement apparatus 10 of the instant invention essentially comprises a cylindrical container 11 defined by a floor and surrounding container cylindrical side wall 11*a*. A lid member 12 is removably mounted relative to a circular upper terminal end of the side wall 11*a*. A plurality of handles 13 are pivotally and diametrically mounted on opposed sides of the container side wall 11*a* adjacent the upper terminal end.

The lid member 12 includes a central support plate 27, with a plurality of spaced bosses defined by a first and second respective boss 14 and 15, each of a first diameter projecting through the lid member, with the first and second bosses 14 and 15 arranged parallel relative to one another in a diametrically aligned relationship and spaced about a central axis of the lid member 12. A first threaded boss 16 and a second threaded boss 17 are respectively and coaxially formed on upper terminal ends of the first and second bosses 14 and 15 and are each defined by a second diameter less than the first diameter to receive a fastener 28 on each of the threaded bosses 16 and 17. A lid handle 18 is mounted on the first and second bosses 14 and 15, receiving the first and second threaded bosses 16 and 17 therethrough, with the fasteners 28 securing the handle 18 to the first and second bosses 14 and 15. A first inner link 19 is pivotally mounted to the first boss, and a second link 20 is pivotally mounted to the second boss at rear terminal ends of each of the first and second inner links. A first spring 21 is mounted to a forward end of the first inner link 19, with a second spring 22 mounted to a forward end of the second inner link 20 at rear terminal ends of each of the first and second springs. Forward ends of the first and second springs 21 and 22 respectively pivotally mount first and second outer links 23 and 24 adjacent rear terminal ends of the first and second outer links 23 and 24. Forward ends of the first and second outer links 23 and 24 pivotally mount first and second hook members 25 and 26 respectively.

Upon rotation of the lid 12 relative to the handles 13, the respective first and second inner links 19 and 20 are rotated to apply tension to the springs 21 and 22 to effect securement of the lid with the springs frictional relationship relative to the top surface 12*a* of the lid 12 maintaining the lid 12 in rotated orientation. Upon rotation of the lid 12 relative to the handles 13 to align the first and second inner links 19 and 20 relative to the handles 13, tension is released relative to the springs 21 and 22 to permit ease of removal of the lid 12 relative to the container 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container lid securement apparatus comprising, a cylindrical container, the cylindrical container including a floor, with a cylindrical side wall fixedly mounted to the floor coaxially aligned therewith, and a lid member secured to an upper terminal end of the cylindrical side wall, and a first and second handle pivotally mounted to the cylindrical side wall, with the first and second handles diametrically aligned relative to one another on the cylindrical side wall, and the lid member including securement means for biased securement of the lid member to the cylindrical container, and wherein the securement means includes a support plate mounted to a bottom surface of the lid member, with the support plate including a first and second boss directed through the lid member extending beyond a top surface of the lid member, wherein the first and second bosses are parallel relative to one another and equally spaced about a lid axis defined by the lid member, and the first and second bosses are defined by a first diameter, and the first boss includes a first threaded boss coaxially aligned with the first boss and mounted to an upper terminal end thereof, with a second threaded boss fixedly mounted to an upper terminal end of the second boss coaxially aligned therewith, wherein the first and second threaded boss are defined by a second diameter less than the first diameter, and a lid handle is mounted to the upper terminal end of the first boss and the upper terminal end of the second boss receiving the first threaded boss and the threaded second boss through the lid handle, with the lid handle spanning the first threaded boss and the second threaded boss, and a fastener mounted to the first boss, and a further fastener mounted to the second boss for fixedly securing the handle in a spaced relationship relative to the top surface of the lid member, and the securement means further including first link means pivotally mounted about the first boss, and second link means pivotally mounted about the second boss, wherein the first link means includes a first hook member securable to the first handle and the second link means includes a second hook member mounted to the second handle.

2. An apparatus as set forth in claim 1 wherein the first link means includes a first inner link, with the first inner link including a rear terminal end pivotally mounted to the first boss, and the second link means includes a second inner link, with the second inner link including a rear terminal end pivotally mounted to the second boss, and the first inner link includes a first inner link forward terminal end, and the second inner link includes a second inner link forward terminal end, wherein the first and second forward terminal ends are mounted to respective first and second springs at rear terminal ends of the first and second springs, and the first and second springs including respective first and second outer links pivotally mounted to forward terminal ends of the first and second springs, with the first and second outer links pivotally mounted to the respective first and second hook members.

* * * * *